US008064620B2

(12) United States Patent
Huang et al.

(10) Patent No.: US 8,064,620 B2
(45) Date of Patent: Nov. 22, 2011

(54) DRIVER CIRCUIT AND DRIVING METHOD FOR ELECTROSTATIC LOUDSPEAKER

(75) Inventors: Pei-Cheng Huang, Jhubei (TW); Jwin-Yen Guo, Jhubei (TW); Kuo-Chi Liu, Hsinchu (TW)

(73) Assignee: Richtek Technology Corporation, R.O.C. (TW)

( * ) Notice: Subject to any disclaimer, the term of this patent is extended or adjusted under 35 U.S.C. 154(b) by 700 days.

(21) Appl. No.: 12/229,369

(22) Filed: Aug. 22, 2008

(65) Prior Publication Data

US 2009/0080676 A1 Mar. 26, 2009

(30) Foreign Application Priority Data

Sep. 21, 2007 (TW) ..... 96135443 A

(51) Int. Cl.
*H04R 3/00* (2006.01)

(52) U.S. Cl. ..... 381/116; 381/77

(58) Field of Classification Search ..... 381/116, 381/77

See application file for complete search history.

(56) References Cited

U.S. PATENT DOCUMENTS

2004/0013274 A1* 1/2004 Bellan et al. ..... 381/77

* cited by examiner

*Primary Examiner* — Douglas Menz

(74) *Attorney, Agent, or Firm* — Tung & Associates

(57) ABSTRACT

The present invention discloses a driver circuit for an electrostatic loudspeaker, comprising: a digital modulation encoder for receiving a digital audio signal and a fixed frequency pulse signal, and mixing them by modulation; a digital to analog converter for converting the output of the digital modulation encoder to an analog signal; a transformer for adjusting the voltage amplitude of the analog signal; and a demodulator for demodulating the adjusted analog signal to driver a speaker.

13 Claims, 3 Drawing Sheets

DRIVER CIRCUIT AND DRIVING METHOD FOR ELECTROSTATIC LOUDSPEAKER

FIELD OF THE INVENTION

The present invention relates to a driver circuit and a driving method for an electrostatic loudspeaker (ESL).

DESCRIPTION OF RELATED ART

FIG. 1 shows a conventional ESL which includes a diaphragm 101 and surrounding stators 102. The diaphragm 101 receives a high DC voltage of about 2000-3000 volts. The surrounding stators 102 receive an AC sinusoidal wave of about several hundred volts to generate audible sound. Since the ESL uses high voltage AC sinusoidal signals to generate sound, its driver circuit must use a low frequency broad band high power transformer 103 so that the signals generated by the audio amplifier 104 can be transformed to the high voltage AC sinusoidal signals required by the ESL.

A low frequency broad band high power transformer is an expensive component whose cost is related to its bandwidth and power. A low frequency broad band high power transformer has a relatively large iron core. Hence, US publication No. 2004/0013274 proposes a different approach. As shown in FIG. 2, in this prior art, a carrier generator 30 generates a carrier wave, which is amplified by an amplifier 18. An audio signal 16 is modulated onto the carrier wave, and the modulated signal passes through a transformer 20, to be demodulated by a demodulator 38 to restore the original audio signal. The devices 10 and 12 are the stators; the device 14 is the diaphragm; the device 26 represents a DC bias, and the device 28 is a mixer to mix the signals. The modulation by means of a carrier wave helps to modulate the audio signal onto a broad band of a higher frequency, so that the transformer 20 needs not be a low frequency broad band high power transformer; a transformer with a higher central frequency suffices, which costs less.

This cited prior art lacks enabling requirement because it does not disclose the internal structure of the demodulator 38, nor does it describe how the audio signal is modulated with the carrier wave. The demodulator 38 is a key component which has significant impact on the modulation of the audio signal with the carrier wave. If the structure of the demodulator is too complicated or if active devices are required, it would significantly impact the performance of the ESL and the circuit complexity.

Moreover, it is the present trend that the speaker system is applied in a multi-channel stereo sound system. However, if the cited prior art is used to drive a multi-channel ESL, multiple carrier generators 30 are required, which further increases the complexity and the cost of the circuit.

In view of the foregoing drawbacks of the prior art, it is desired to provide an ESL driver circuit with a simpler hardware structure to meet the trend of the present stereo sound system.

SUMMARY OF THE INVENTION

In view of the foregoing, it is an objective of the present invention to provide an ESL driver to meet the trend of the present stereo sound system.

Another objective of the present invention to provide an ESL driving method.

To achieve the above and other objectives, and from one aspect of the present invention, a driver circuit for an electrostatic loudspeaker comprises: a digital modulation encoder for receiving a digital audio signal and a fixed frequency pulse signal, and mixing them by modulation; a digital to analog converter for converting the output of the digital modulation encoder to an analog signal; a transformer for adjusting the voltage amplitude of the analog signal; and a demodulator for demodulating the adjusted analog signal to driver a speaker.

Preferably, the above-mentioned driver circuit for an electrostatic loudspeaker comprises a plurality of transformers and a corresponding plurality of demodulators to drive a corresponding number of speakers. The digital to analog converter generates multiple analog signals which are supplied to the plurality of transformers.

From another aspect of the present invention, a method for driving an electrostatic loudspeaker comprises: receiving an audio signal; amplitude-modulating the audio signal; passing the modulated signal through a transformer; demodulating the modulated signal by a demodulator, wherein the demodulator includes passive devices; and driving a speaker according to the demodulated signal.

Preferably, the audio signal in the above-mentioned method is a digital audio signal, and the step for amplitude-modulating the audio signal includes: combining the digital audio signal with a fixed frequency oscillation signal to form a plurality of high frequency digital output signals; and digital-to-analog converting the high frequency digital output signals to form a corresponding plurality of analog signals. The plurality of analog signals pass through corresponding transformers and are demodulated by corresponding demodulators. The demodulated signals drive corresponding speakers.

These and other objectives, aspects, features, and advantages of the present invention will become better understood with regard to the following description, appended claims, and accompanying drawings.

DESCRIPTION OF THE PREFERRED EMBODIMENTS

Figure 1:
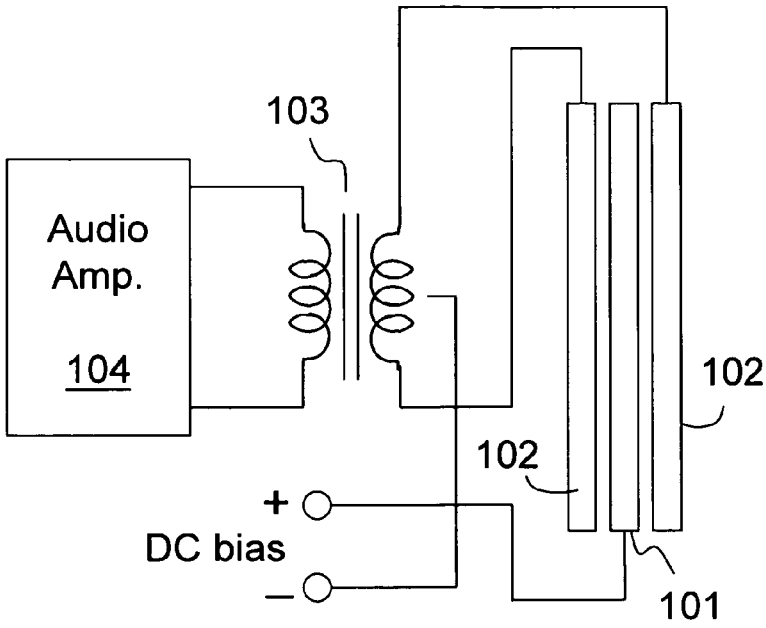
Fig. 1 (Prior Art)
FIG. 1 shows a schematic circuit diagram of a conventional ESL.
Figure 2:
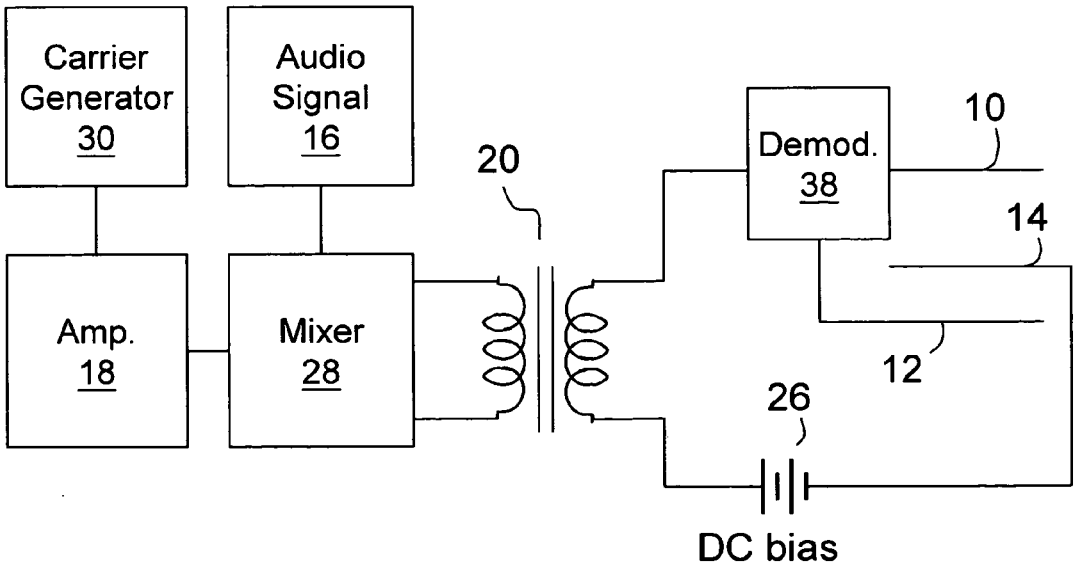
Fig. 2 (Prior Art)
FIG. 2 shows a schematic circuit diagram of another conventional ESL.
Figure 3:
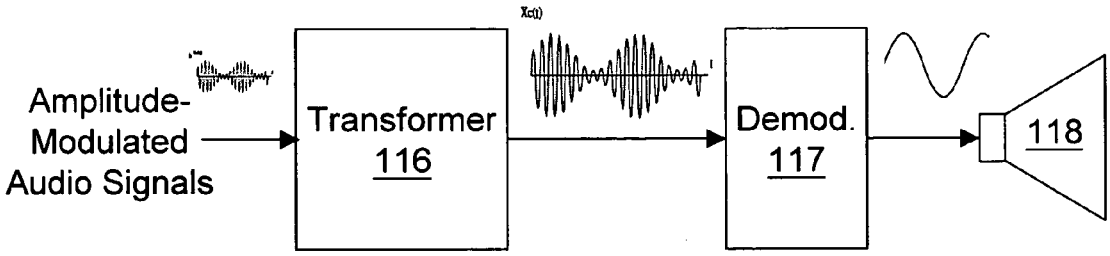
FIG. 3 explains the amplitude modulation concept of the present invention.
Figure 4:
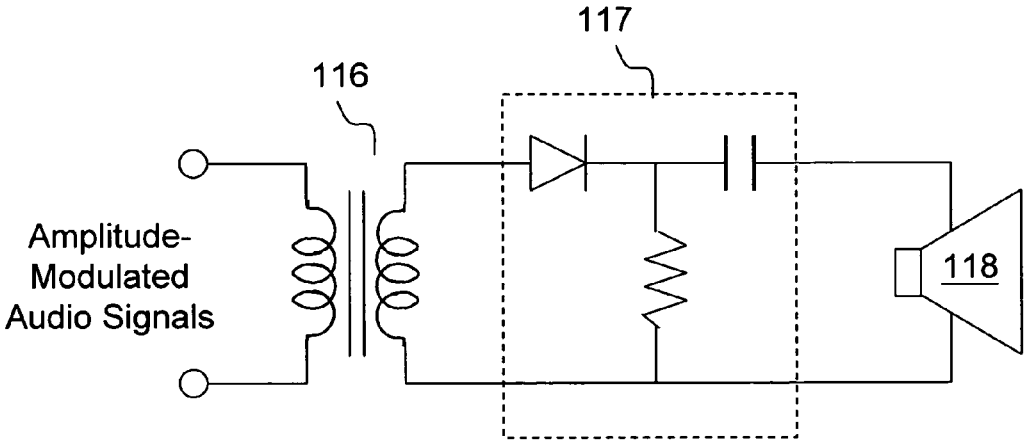
FIG. 4 is a schematic circuit diagram showing an example of a demodulator.

FIG. 3 is a schematic circuit diagram illustrating the concept of the present invention, in which the transformer 116, the demodulator 117 and the speaker 118 are illustrated in a simplified form. In the present invention, audio signals are amplitude-modulated, so that the demodulator 117 can be embodied by simple passive components. By way of example, FIG. 4 shows one such demodulator 117.

Figure 5:
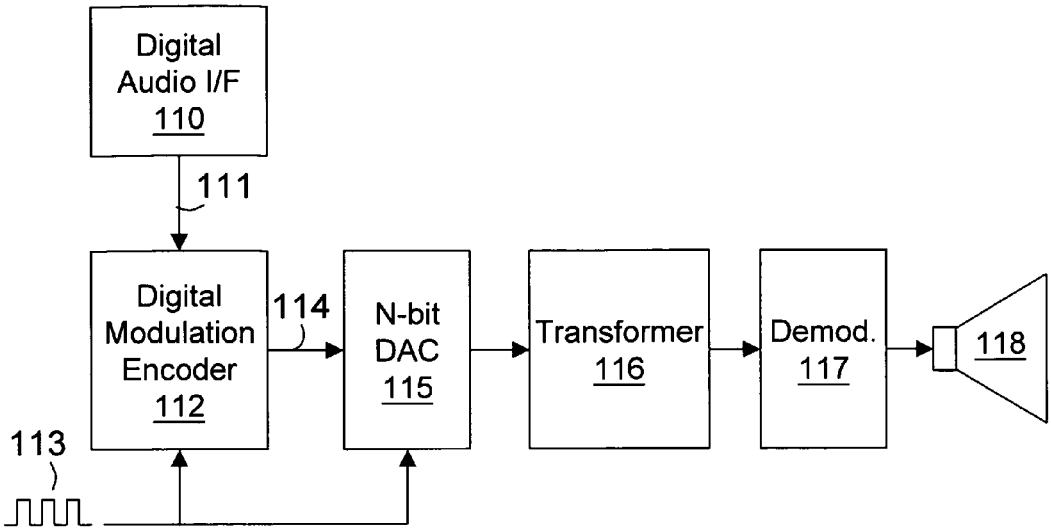
FIGS. 5 and 6 show two embodiments of the present invention.

Referring to FIG. 5, nowadays almost all of the audio signals are in digital form. In this embodiment, a digital audio signal 111 is combined with a fixed frequency oscillation signal 113 in a digital modulation encoder 112. The fixed frequency oscillation signal 113 for example can be the clock signal of the system, so that it is not necessary to provide a carrier generator for generating an additional carrier signal. The resultant modulated signal 114 is input to an N-bit digital to analog converter (DAC) 115, to be converted to a high frequency analog signal; furthermore, the frequency of the signal is compressed in a bandwidth that is capable of passing through the transformer 116. Thereafter, the signal can be demodulated in the manner shown in FIGS. 3 and 4, to drive the speaker 118. In this embodiment, as shown in FIG. 5, the fixed frequency oscillation signal 113 is the clock input of the N-bit DAC 115, which implies that the fixed frequency oscillation signal 113 is the system clock. However, the present invention is not limited to this; in another embodiment, to better fit the bandwidth of the transformer 116, the fixed frequency oscillation signal 113 can be a frequency-division signal of the system clock.

Figure 6:
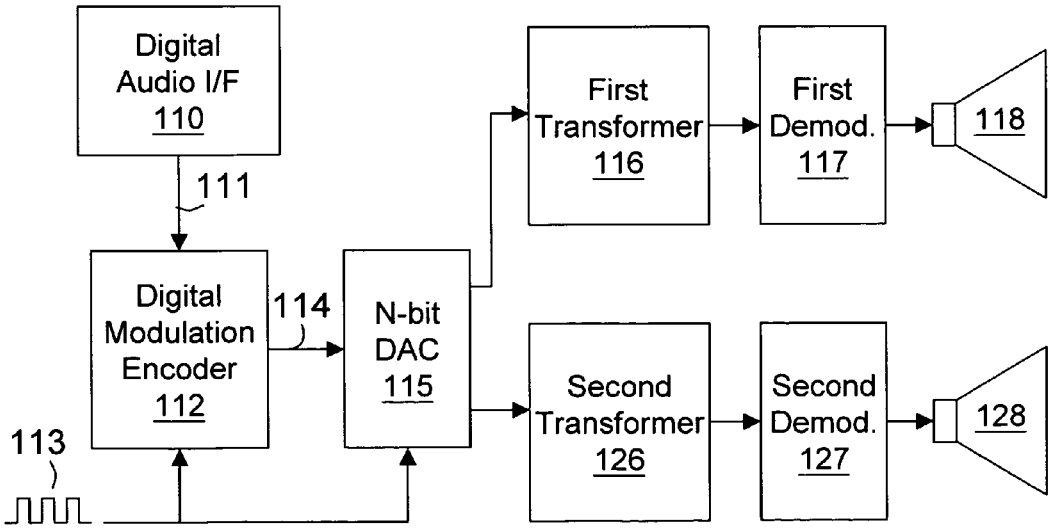

The present invention is better than the previously cited prior art in that, first, it is not necessary to additionally provide a carrier generator. Second, as referring to FIG. 6, the present invention can drive multiple speaker channels with a simple circuit structure. As shown in the figure, it is very easy for the N-bit DAC 115 to generate multiple analog output signals from one digital input signal. The analog output signals are respectively sent to a first and a second transformer 116 and 126, to be demodulated by a first and a second demodulator 117 and 127, to respectively drive a first and a second speaker 118 and 128. Thus, the present invention better fits the requirement in the present trend with respect to the digital multiple-channel applications.

Although the present invention has been described in considerable detail with reference to certain preferred embodiments thereof, they are for illustrative purpose, and not for limiting the scope of the present invention. Other variations and modifications are possible and may be readily conceived by one skilled in this art, under the teaching of the present invention. Therefore, it is intended that the present invention cover all such modifications and variations, which should be interpreted to fall within the scope of the following claims and their equivalents.

What is claimed is:

1. A driver circuit for an electrostatic loudspeaker, comprising:

a digital modulation encoder for receiving a digital audio signal and a fixed frequency pulse signal, and mixing them by modulation;

a digital to analog converter for converting the output of the digital modulation encoder to an analog signal;

a transformer for adjusting the voltage amplitude of the analog signal; and a demodulator for demodulating the adjusted analog signal to, drive a speaker, wherein the demodulator consists of passive devices.

2. The driver circuit of claim 1, wherein the digital modulation encoder combines the digital audio signal with a fixed frequency oscillation signal.

3. The driver circuit of claim 2, wherein the fixed frequency oscillation signal is a clock signal or a frequency-division signal of a clock signal.

4. The driver circuit of claim 1, wherein the digital modulation encoder receives the digital audio signal from a digital communication interface.

5. The driver circuit of claim 1, wherein the passive devices include a diode, a resistor and a capacitor coupled to a common node.

6. The driver circuit of claim 1, comprising at least two transformers and at least two demodulators to drive a corresponding number of speakers.

7. The driver circuit of claim 6, wherein the digital to analog converter generates at least two analog signals to be supplied to the at least two transformers.

8. A method for driving an electrostatic loudspeaker comprises:

receiving an audio signal;

amplitude-modulating the audio signal;

passing the modulated signal through a transformer;

demodulating the modulated signal by a demodulator, wherein the demodulator consists of passive devices; and driving a speaker according to the demodulated signal.

9. The method of claim 8, wherein the audio signal is a digital audio signal, and the step for amplitude-modulating the audio signal includes: combining the digital audio signal with a fixed frequency oscillation signal.

10. The method of claim 9, wherein the fixed frequency oscillation signal is a clock signal or a frequency-division signal of a clock signal.

11. The method of claim 9, further comprising: after the combination of the digital audio signal with a fixed frequency oscillation signal, converting the combination signal to at least one analog signal.

12. The method of claim 11, wherein the converting step generates multiple analog signals.

13. The method of claim 12, wherein the multiple analog signals pass through corresponding transformers and are demodulated by corresponding demodulators, to drive corresponding speakers.

* * * * *